US010608387B2

(12) United States Patent
Uratani

(10) Patent No.: US 10,608,387 B2
(45) Date of Patent: Mar. 31, 2020

(54) COAXIAL CONNECTOR

(71) Applicant: Murata Manufacturing Co., Ltd., Kyoto-fu (JP)

(72) Inventor: Chikara Uratani, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/375,769

(22) Filed: Apr. 4, 2019

(65) Prior Publication Data

US 2019/0237918 A1 Aug. 1, 2019

Related U.S. Application Data

(63) Continuation of application No. PCT/JP2017/036041, filed on Oct. 3, 2017.

(30) Foreign Application Priority Data

Oct. 18, 2016 (JP) ..... 2016-204079

(51) Int. Cl.
*H01R 12/00* (2006.01)
*H01R 24/38* (2011.01)

(52) U.S. Cl.
CPC ..... *H01R 24/38* (2013.01)

(58) Field of Classification Search
CPC .... H01R 17/125; H01R 9/0518; H01R 17/12; H01R 103/00; H01R 13/113; H01R 9/053
USPC ..... 439/63, 578–585, 854, 855, 859, 394, 439/675
See application file for complete search history.

(56) References Cited

U.S. PATENT DOCUMENTS 7,118,383 B2 * 10/2006 Nagata ..... H01R 13/6315 439/63

FOREIGN PATENT DOCUMENTS

| | | | |
|---|---|---|---|
| JP | 2009-104836 | A | 5/2009 |
| JP | 2013-098122 | A | 5/2013 |
| JP | 2015-076312 | A | 4/2015 |
| JP | 5832906 | B2 | 12/2015 |

OTHER PUBLICATIONS

International Search Report issued in PCT/JP2017/036041; dated Dec. 12, 2017.
Written Opinion issued in PCT/JP2017/036041; dated Dec. 12, 2017.

* cited by examiner

*Primary Examiner* — Phuong Chi Thi Nguyen
(74) *Attorney, Agent, or Firm* — Studebaker & Brackett PC

(57) ABSTRACT

A coaxial connector includes a first connector and a second connector, where a first connector and a second connector are aligned easily and a height dimension caused when the first connector and the second connector are connected is small. The first connector includes solder parts. Skirt parts that serve as a guide for alignment in connecting the first connector and the second connector are integrally formed with the outer conductor of the second connector. Cut portions are provided in portions that are included in the skirt parts and face the solder part. When the first connector and the second connector are connected, the solder parts are received in the cut portions.

8 Claims, 9 Drawing Sheets

COAXIAL CONNECTOR

CROSS-REFERENCE TO RELATED APPLICATIONS

This application claims benefit of priority to International Patent Application No. PCT/JP2017/036041, filed Oct. 3, 2017, and to Japanese Patent Application No. 2016-204079, filed Oct. 18, 2016, the entire contents of each are incorporated herein by reference.

BACKGROUND

Technical Field

The present disclosure relates to a coaxial connector that includes a first connector and a second connector and more specifically to a coaxial connector where a first connector and a second connector are aligned easily and a height dimension caused when the first connector and the second connector are connected is small.

Background Art

Japanese Unexamined Patent Application Publication No. 2013-98122 discloses a conventional coaxial connector. FIGS. 8A and 8B illustrate a coaxial connector 500 disclosed in Japanese Unexamined Patent Application Publication No. 2013-98122. The coaxial connector 500 is made up of a first connector (coaxial connector receptacle) 500A and a second connector (coaxial connector plug) 500B. FIG. 8A illustrates a state before the first connector 500A and the second connector 500B are connected and FIG. 8B illustrates a state after the first connector 500A and the second connector 500B are connected.

The first connector 500A includes a cylindrical outer conductor (outer conductor part) 51 and a center pin (center conductor part) 52. A lock groove 53 is formed in an outer edge portion of the outer conductor 51. In the first connector 500A, a solder part (outer conductor) 54*a* and a solder part (center conductor) 54*b* are formed, which extend in a plane direction. The solder parts 54*a* and 54*b* are used for soldering in mounting the first connector 500A on a land electrode of a board. The solder part 54*a* is integrally formed with the outer conductor 51 and the solder part 54*b* is integrally formed with the center pin 52.

The second connector 500B includes a cylindrical outer conductor (outer conductor part) 55 and a socket (center conductor) 56. A skirt part 57 that serves as a guide for alignment in connecting the first connector 500A and the second connector 500B is integrally formed with the outer conductor 55. Further, a lock projection 58 is formed in an inner edge portion of the outer conductor 55 and in a base portion of the skirt part 57.

As illustrated in FIG. 8B, the coaxial connector 500 is used by connecting the outer conductor 51 of the first connector 500A and the outer conductor 55 of the second connector 500B and connecting the center pin 52 of the first connector 500A and the socket 56 of the second connector 500B. At this time, the lock projection 58 of the second connector 500B is fitted (locked) in the lock groove 53 of the first connector 500A.

SUMMARY

With increase in the length of the skirt part 57 of the second connector 500B in the coaxial connector 500, a so-called induction amount becomes larger while the skirt part 57 can come into contact more easily with an edge portion of an opening on the upper side of the outer conductor 51 of the first connector 500A and alignment in connecting the first connector 500A and the second connector 500B is facilitated. Therefore, lengthening the long skirt part 57 is preferable.

In the coaxial connector 500, however, lengthening the skirt part 57 of the second connector 500B causes the skirt part 57 to interfere (come into contact) with the solder parts 54*a* and 54*b* of the first connector 500A. Thus, simply lengthening the skirt part 57 has been limited.

It is conceivable accordingly as a measure to lengthen the skirt part 57 by raising the height of the outer conductor 51 of the first connector 500A and shifting the formation position of the lock groove 53 upward. In this case, however, there is a problem that a height dimension of the coaxial connector 500 caused when the first connector 500A and the second connector 500B are connected becomes large.

The present disclosure thus provides a coaxial connector including a first connector including a cylindrical outer conductor, and a center pin or a socket; and a second connector including a cylindrical outer conductor, and a socket or a center pin. The coaxial connector is used by connecting the outer conductor of the first connector and the outer conductor of the second connector, and additionally connecting the center pin of the first connector and the socket of the second connector or additionally connecting the socket of the first connector and the center pin of the second connector. The first connector includes a solder part that is for mounting and projects in a plane direction, a skirt part being integrally formed with the outer conductor of the second connector and serving as a guide for alignment in connecting the first connector and the second connector, a cut portion being provided in a portion that is included in the skirt part and faces the solder part, such that when the first connector and the second connector are connected, the solder part is received in the cut portion.

Preferably, the first connector includes the center pin, and the second connector includes the socket. A slit-like juncture is formed in the outer conductor of the second connector in at least one location, and the outer conductor of the second connector is cylindrical. The socket of the second connector is made up of a cylindrical part and includes a slit-like juncture formed in at least one location. When viewed from a center axis of the second connector, a direction in which the juncture of the outer conductor of the second connector is formed and a direction in which the juncture of the socket of the second connector is formed agree. In this case, in connecting the first connector and the second connector, the center of the outer conductor of the second connector and the center of the socket of the second connector cooperate and move in the same direction. Thus, the socket can be prevented from receiving unneeded stress and be prevented from getting damaged.

Preferably, a lock groove is formed in an outer edge portion of the outer conductor of the first connector, a lock projection is formed in an inner edge portion of the outer conductor of the second connector and in a base portion of the skirt part. When the first connector and the second connector are connected, the lock projection is fitted in the lock groove. In this case, the first connector and the second connector can be connected with reliability.

Preferably, the lock groove of the first connector is divided into two portions, and the skirt part and the lock projection of the second connector are also each divided into two portions. In this case, the lock grooves and the lock projections can each be provided symmetrically at two locations and thus, the first connector and the second connector can be connected in a more suitable state. Also in this case, a cut portion is provided in a portion that is included in the skirt part of the second connector and faces the solder part of the first connector. Accordingly, the cut portion may be formed in each of the two portions obtained by dividing the skirt part.

In the coaxial connector according to the present disclosure, when the first connector and the second connector are connected, the solder part formed in the first connector is received in the cut portion formed in the skirt part of the second connector. Thus, the skirt part can be made long. Accordingly, in the coaxial connector according to the present disclosure, the induction amount of the skirt part is large and as a result, alignment in connecting the first connector and the second connector can be facilitated.

Further, in the coaxial connector according to the present disclosure, when the first connector and the second connector are connected, the solder part formed in the first connector is received in the cut portion formed in the skirt part of the second connector. Thus, even if the skirt part is made long, a height dimension of the coaxial connector caused when the first connector and the second connector are connected can be made small.

BRIEF DESCRIPTION OF THE DRAWINGS

FIG. 5A is a perspective view illustrating a state before the first connector and the second connector are connected, and FIG. 5B is a perspective view illustrating a state after the first connector and the second connector are connected;

FIG. 8A illustrates a state before the first connector and the second connector are connected, and FIG. 8B illustrates a state after the first connector and the second connector are connected.

DETAILED DESCRIPTION

Figure 1A:
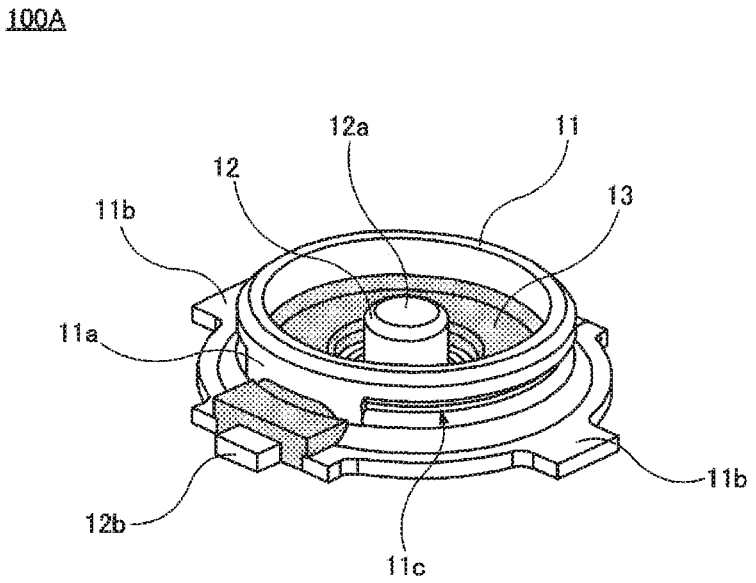
FIG. 1A is a perspective view of a first connector viewed from above.

An embodiment for implementing the present disclosure is described below with reference to the drawings.

The embodiment presents an example of embodiments of the present disclosure and the present disclosure is not limited to the contents of the embodiment. The drawings are intended to facilitate the understanding of the specification and may be illustrated schematically while the dimensional ratios in or between components may disagree with those indicated in the specification. In addition, the components described in the specification may be omitted in the drawings or may be illustrated while being omitted in number.

Figure 1B:
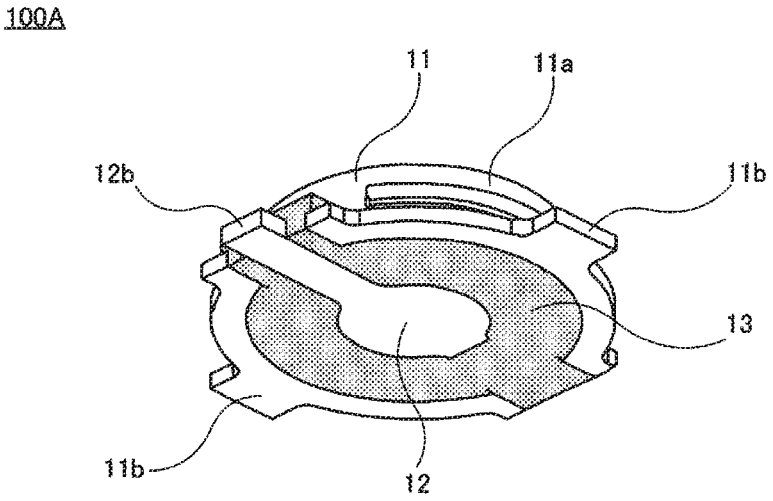
FIG. 1B is a perspective view of the first connector viewed from below, with the first connector and a second connector making up a coaxial connector according to an embodiment.
Figure 2:
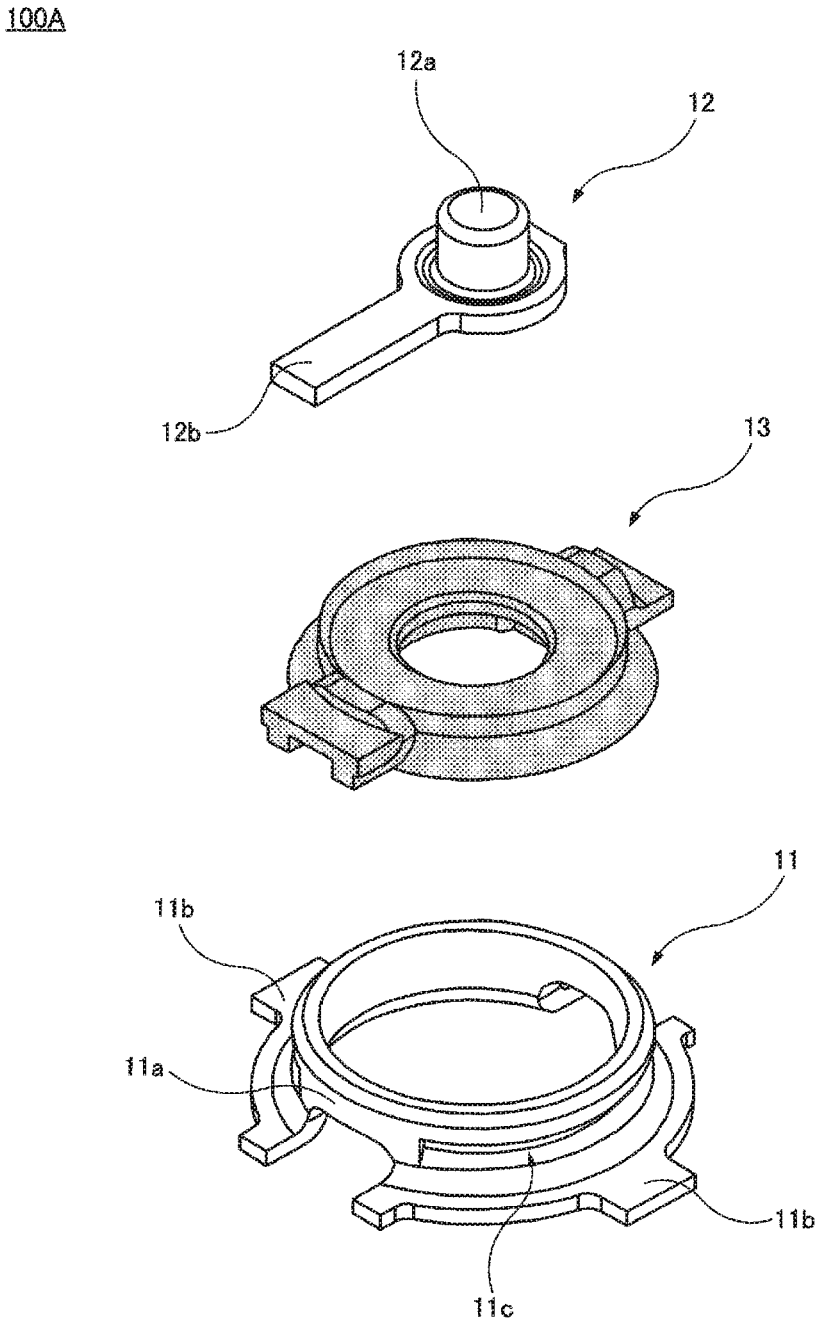
FIG. 2 is an exploded perspective view of the first connector.
Figure 3A:
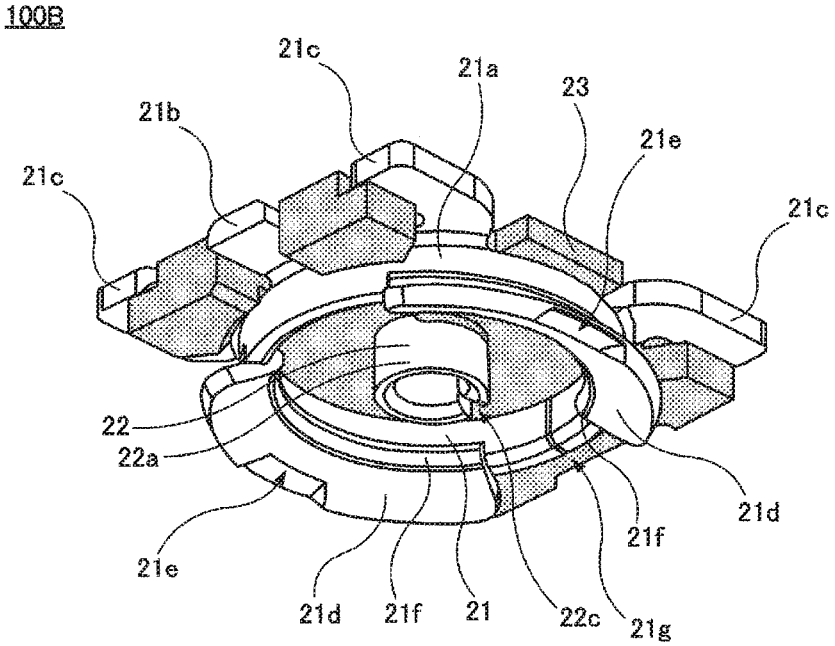
FIG. 3A is a perspective view of the second connector viewed from below.
Figure 3B:
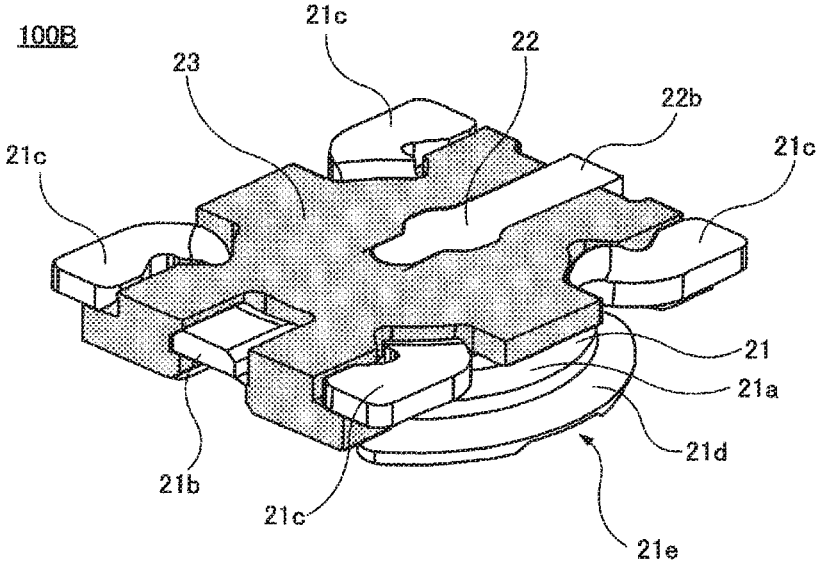
FIG. 3B is a perspective view of the second connector viewed from above.
Figure 4:
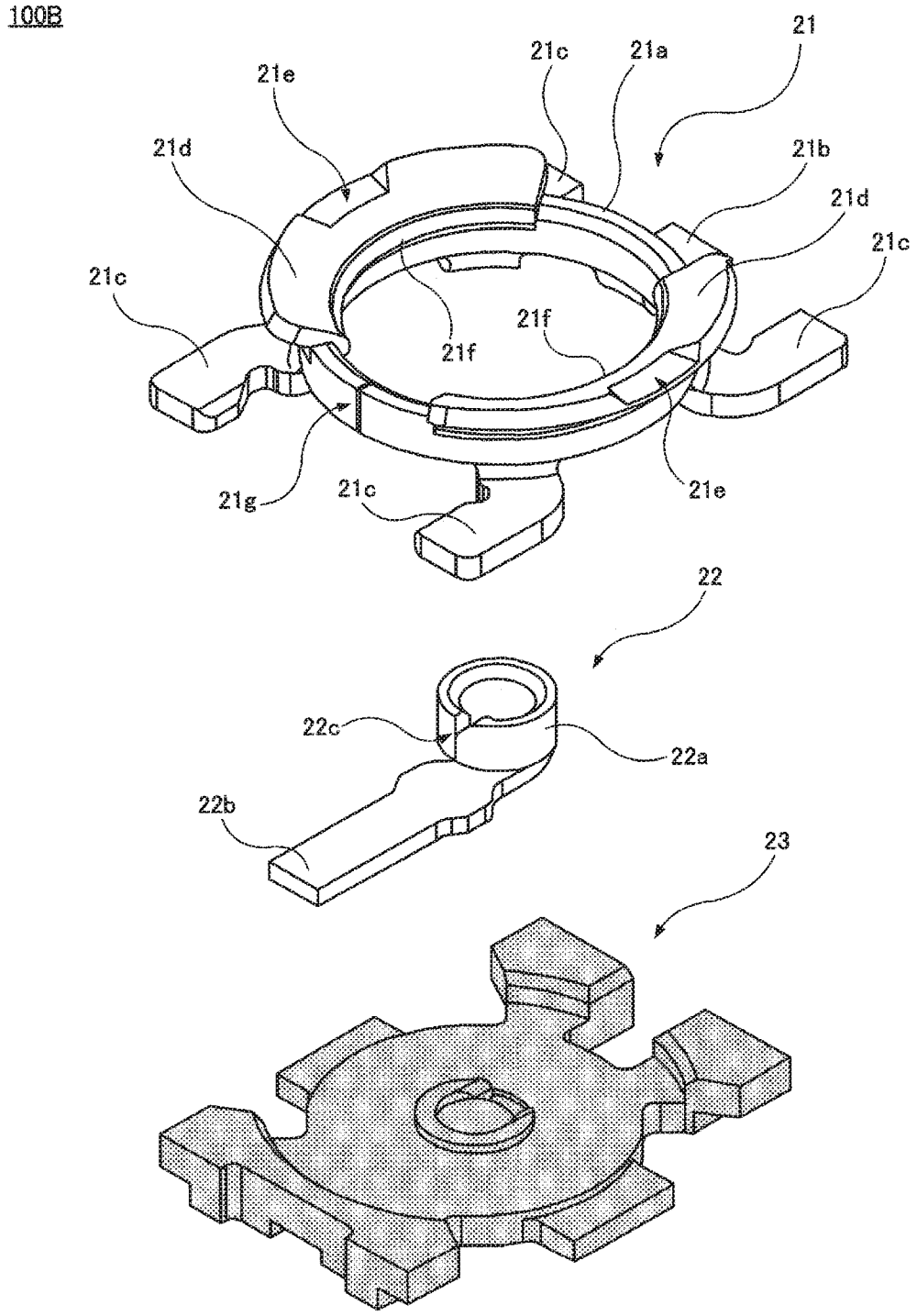
FIG. 4 is an exploded perspective view of the second connector.
Figure 5A:
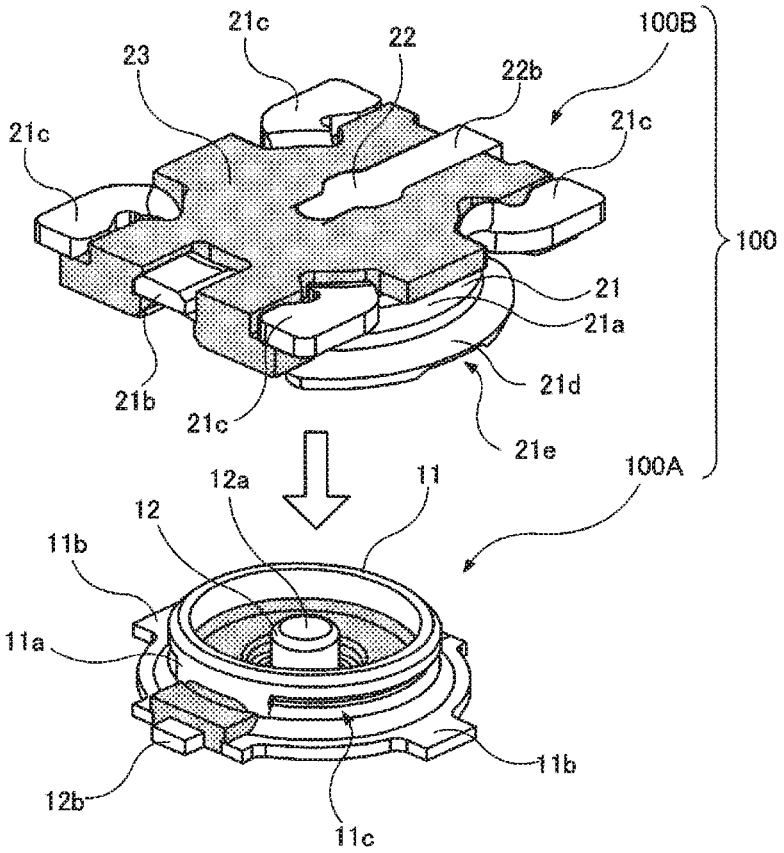
FIGS. 5A and 5B are each a perspective view of the coaxial connector, where
Figure 5B:
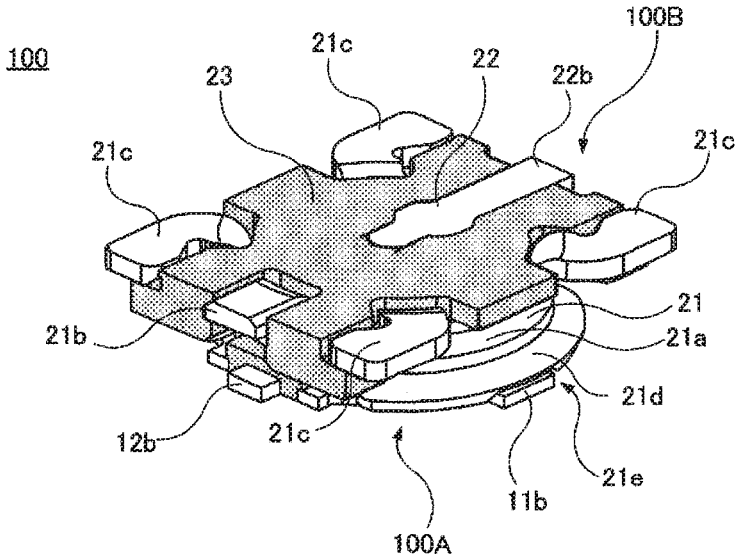
Figure 6:
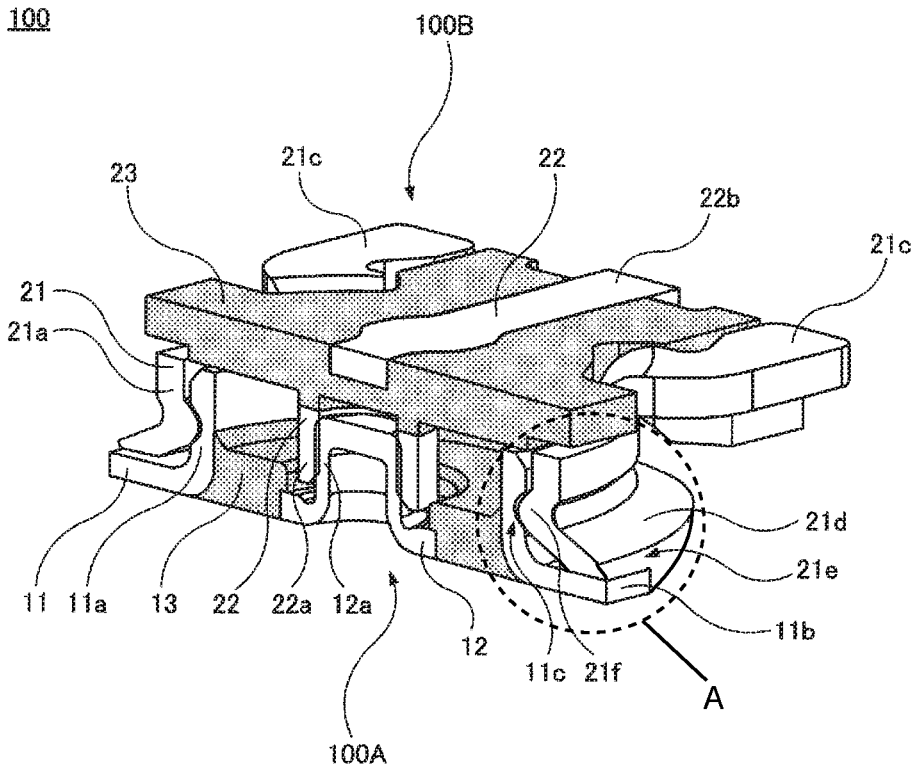
FIG. 6 is a cross-sectional perspective view of the coaxial connector where the first connector and the second connector are connected.
Figure 6A:
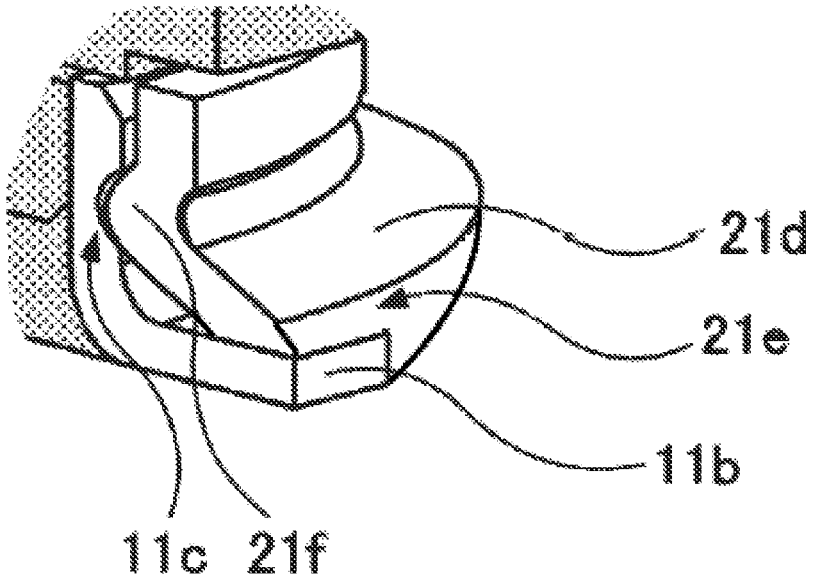
FIG. 6A is an enlarged view of the area designated as A in FIG. 6.

FIGS. 1 to 6 illustrate a coaxial connector 100 according to an embodiment. The coaxial connector 100 is made up of a first connector 100A and a second connector 100B, which can be connected to each other. FIG. 1A is a perspective view of the first connector 100A viewed from above and FIG. 1B is a perspective view of the first connector 100A viewed from below. FIG. 2 is an exploded perspective view of the first connector 100A. FIG. 3A is a perspective view of the second connector 100B viewed from below and FIG. 3B is a perspective view of the second connector 100B viewed from above. FIG. 4 is an exploded perspective view of the second connector 100B. FIG. 5A is a perspective view illustrating the coaxial connector 100 before the first connector 100A and the second connector 100B are connected and FIG. 5B is a perspective view after the first connector 100A and the second connector 100B are connected. FIG. 6 is a cross-sectional perspective view of the coaxial connector 100 where the first connector 100A and the second connector 100B are connected.

As illustrated in FIGS. 1A, 1B, and 2, the first connector 100A includes a cylindrical outer conductor 11, a center pin 12, and an insulator 13. The outer conductor 11 and the center pin 12 are each made of, for example, a worked metal plate of phosphor bronze or the like and plated with Ni, Ag, Au, or the like on their surfaces. The insulator 13 is made of resin. The outer conductor 11 and the center pin 12 undergo insert-molding with the insulator (resin) 13 to be held thereby.

The outer conductor 11 includes a cylindrical tubular part 11*a* as a body part. The tubular part 11*a* is open on both the upper and lower sides. The inside between the openings is covered with the insulator 13.

The outer conductor 11 includes a pair of solder parts 11*b*. The pair of solder parts 11*b* is formed so as to be apart from each other by an angle of 180 degrees and project in a plane direction from an edge portion of one of the openings of the tubular part 11*a*. A pair of lock grooves 11*c* is formed in an outer edge portion of the tubular part 11*a* of the outer conductor 11.

The center pin 12 includes a cylindrical connection part 12*a*. The connection part 12*a* is formed by drawing or forging. The center pin 12 includes a solder part 12*b*, which extends from the connection part 12*a* in a plane direction.

The first connector 100A is used by being mounted on a ceramic board, a resin board, a flexible board with flexibility, or the like through soldering of the solder parts 11*b* of the outer conductor 11 and the solder part 12*b* of the center pin 12 onto land electrodes for example. As illustrated in FIGS. 3A, 3B, and 4, the second connector 100B includes a cylindrical outer conductor 21, a socket 22, and an insulator 23. The outer conductor 21 and the socket 22 are each made of, for example, a worked metal plate of phosphor bronze or the like and plated with Ni, Ag, Au, or the like on their surfaces. The insulator 13 is made of resin. After insert-molding the insulator (resin) 23 with the socket 22, the outer conductor 21 is attached to the insulator 23.

The outer conductor 21 includes a cylindrical tubular part 21*a* as a body part. The tubular part 21*a* is open on both the upper and lower sides. The inside between the openings is covered with the insulator 23. The inside diameter of the tubular part 21*a* is set to a value that enables the tubular part 11*a* of the outer conductor 11 of the first connector 100A to be fitted in the tubular part 21*a*.

The outer conductor 21 includes a solder part 21*b*. The solder part 21*b* is formed so as to project in a plane direction from an edge portion of the one of the openings of the tubular part 21*a*. The outer conductor 21 includes four leg parts 21*c*. The four leg parts 21*c* are also each formed so as to project in a plane direction from an edge portion of one of the openings of the tubular part 21*a*.

The outer conductor 21 includes a pair of skirt parts 21*d*, which serves as a guide for alignment in connecting the first connector 100A and the second connector 100B. The pair of skirt parts 21*d* is each formed in an edge portion of the opening on the side different from the side on which the solder part 21*b* and the leg parts 21*c* of the tubular part 21*a* are formed. The pair of skirt parts 21*d* is each formed into a tapered shape so as to become wider as the distance from the tubular part 21*a* increases.

A cut portion 21*e* is formed centrally in an edge portion of each skirt part 21*d* of the outer conductor 21. The cut portions 21*e* are formed in positions that correspond to the solder parts 11*b* of the outer conductor 11 of the first connector 100A when the first connector 100A and the second connector 100B are connected.

A lock projection 21*f* is formed in a base portion of the outer conductor 21 of each skirt part 21*d*, which is toward the tubular part 21*a*. The tubular part 21*a* of the outer conductor 21 includes a slit-like juncture 21*g*, which divides the tubular part 21*a* in a height direction.

The socket 22 includes a cylindrical connection part 22*a*. The inside diameter of the connection part 22*a* is set to a value that enables the connection part 12*a* of the center pin 12 of the first connector 100A to be fitted in the connection part 22*a*.

Figure 7:
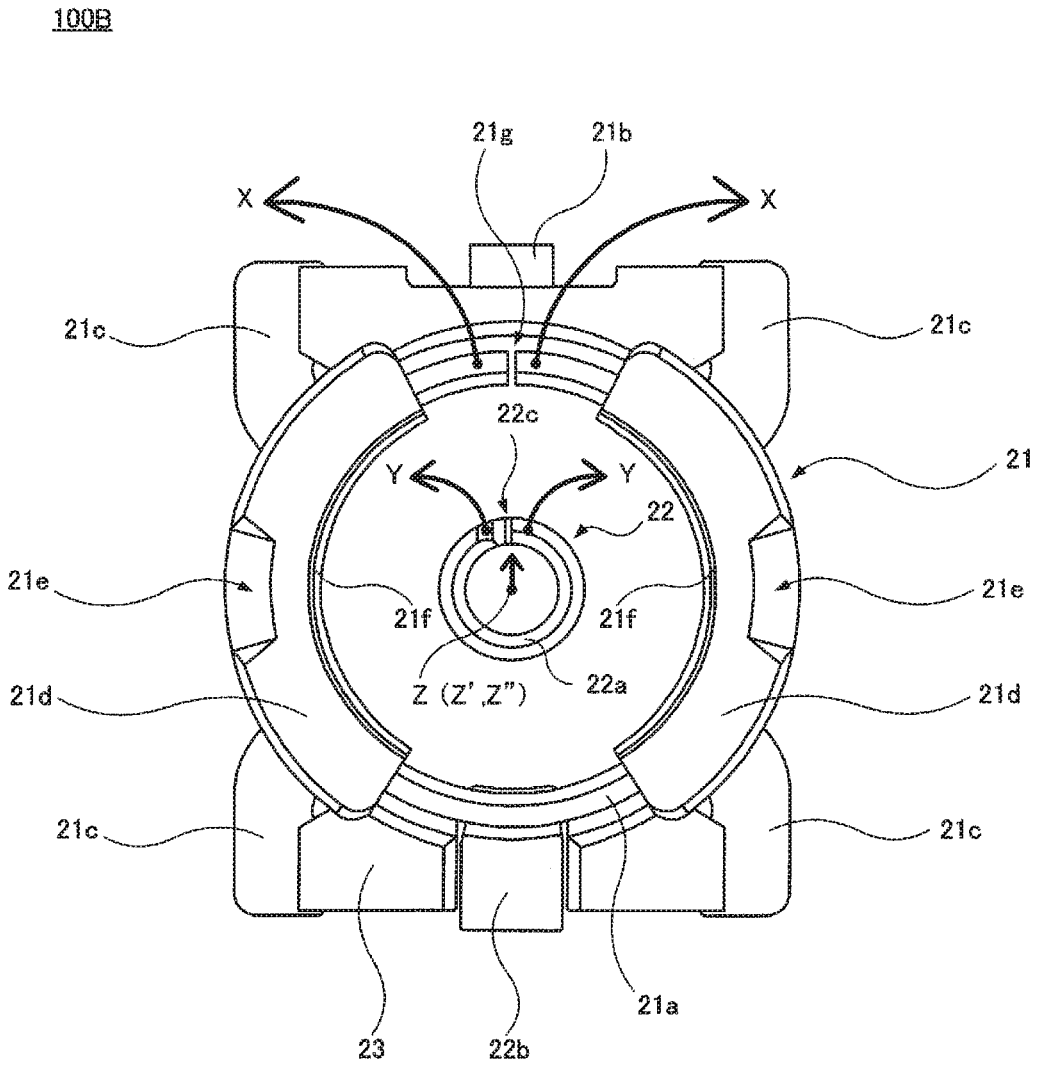
FIG. 7 is a plan view of the second connector on the side where a socket is formed.
Figure 8A:
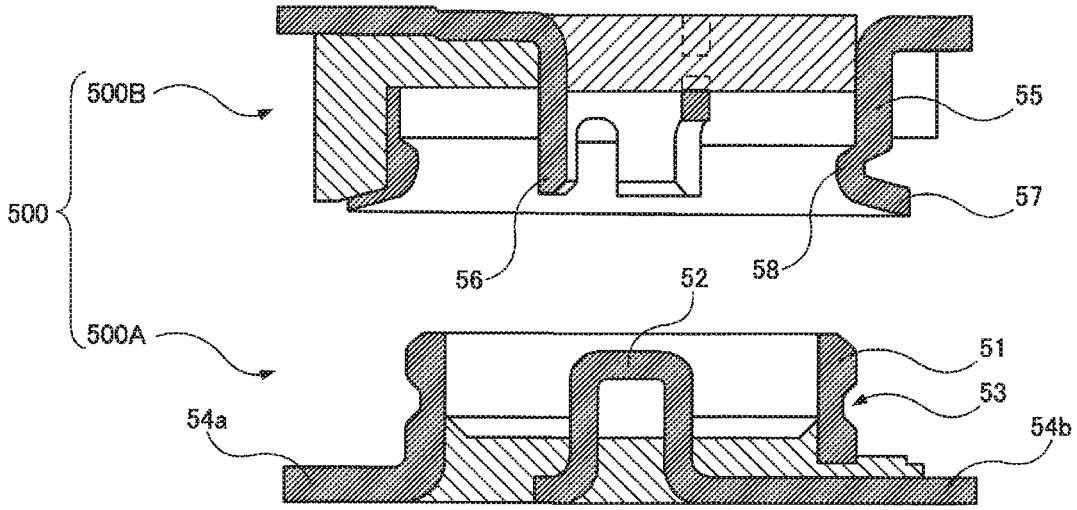
FIG. 8A (PRIOR ART)
FIGS. 8A and 8B are each a cross-sectional view of a coaxial connector that is described in Japanese Unexamined Patent Application Publication No. 2013-98122 and made up of a first connector and a second connector, where
Figure 8B:
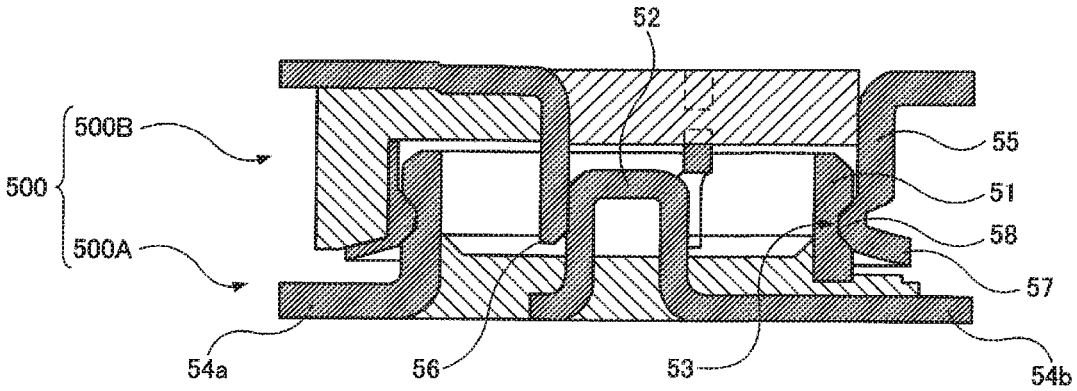
FIG. 8B (PRIOR ART)

The socket 22 includes a solder part 22*b*, which extends from the connection part 22*a* in a plane direction. The cylindrical connection part 22*a* of the socket 22 also includes a slit-like juncture 22*c*, which divides the connection part 22*a* in the height direction. As illustrated in FIG. 7, when viewed from a center axis Z of the second connector 100B, the direction in which the juncture 22*c* of the connection part 22*a* of the socket 22 is formed agrees with the direction in which the juncture 21*g* of the tubular part 21*a* of the outer conductor 21 is formed.

The second connector 100B is used by being mounted on a ceramic board, a resin board, a flexible board with flexibility, or the like through soldering of the solder part 21*b* and the four leg parts 21*c* of the outer conductor 21, and the solder part 22*b* of the socket 22 onto land electrodes for example.

Both the first connector 100A and the second connector 100B of the coaxial connector 100 can be manufactured by a manufacturing method used widely to date for manufacturing coaxial connectors. Brief description thereof is provided below.

First, a metal plate of, for example, phosphor bronze is prepared as a material for each of the outer conductor 11 and the center pin 12 of the first connector 100A, and the outer conductor 21 and the socket 22 of the second connector 100B.

Next, a process such as punching, bending, drawing, cutting, or forging is performed on the prepared metal plates as needed to make the outer conductor 11, the center pin 12, the outer conductor 21, and the socket 22. Typically, such processes are performed in a state where the outer conductor 11, the center pin 12, the outer conductor 21, and the socket 22 are each connected to a lead frame.

In the above-mentioned processes, the formation of the cut portions 21*e* in the skirt parts 21*d* of the outer conductor 21 of the second connector 100B may be performed by punching or be performed by hammering, crushing, or the like.

After that, plating is performed on the respective surfaces of the outer conductor 11, the center pin 12, the outer conductor 21, and the socket 22.

Subsequently, a die is prepared, and the outer conductor 11 and the center pin 12 are received into the die. After that, resin is poured into the die and solidified to mold the insulator 13 into a predetermined shape. That is, the insulator 13 is insert-molded with the outer conductor 11 and the center pin 12. Similarly, the socket 22 is received into the die. After that, resin is poured into the die and solidified to mold the insulator 23 into a predetermined shape. That is, the insulator 23 is insert-molded with the socket 22. Subsequently, the outer conductor 21 is attached to the insulator 23 insert-molded with the socket 22. Typically, such processes are also each performed in a state where the outer conductor 11, the center pin 12, the outer conductor 21, and the socket 22 are connected to a lead frame, and at a suitable stage, an unneeded lead frame is brought into disconnection.

As described above, the first connector 100A and the second connector 100B are completed.

Described below is how to connect the first connector 100A and the second connector 100B.

First, as illustrated in FIG. 5A, the center axis of the first connector 100A and the center axis of the second connector 100B are aligned and then the side on which the center pin 12 of the first connector 100A is formed and the side on which the socket 22 of the second connector 100B, not illustrated in FIG. 5A, is formed are caused to face each other to arrange the first connector 100A and the second connector 100B. At this time, the first connector 100A and the second connector 100B are each mounted on a board or the like already.

After that, the second connector 100B is brought closer to the first connector 100A.

As a result, first, the skirt parts 21*d* of the outer conductor 21 of the second connector 100B abuts on the edge portion of the opening that is included in the tubular part 11*a* of the outer conductor 11 of the first connector 100A and is on the side on which the center pin 12 is formed. As the second connector 100B is brought further closer to the first connector 100A, the center axis of the first connector 100A and the center axis of the second connector 100B come into precise agreement while guided by the skirt parts 21*d* each formed in a tapered shape. That is, the skirt parts 21*d* function as a guide for alignment in connecting the first connector 100A and the second connector 100B.

As the second connector 100B is brought further closer to the first connector 100A, as illustrated in FIGS. 5B) and 6, the tubular part 11*a* of the outer conductor 11 of the first connector 100A is fitted into the tubular part 21*a* of the outer conductor 21 of the second connector 100B, and the connection part 12*a* of the center pin 12 of the first connector 100A is fitted into the connection part 22*a* of the socket 22 of the second connector 100B.

Finally, the lock projections 21*f* of the outer conductor 21 of the second connector 100B are fitted in the lock grooves 11*c* of the outer conductor 11 of the first connector 100A and the connection of the first connector 100A and the second connector 100B is complete. In the state where the first connector 100A and the second connector 100B are connected, the solder parts 11*b* of the outer conductor 11 of the first connector 100A are received in the cut portions 21*e* of the skirt parts 21*d* of the outer conductor 21 of the second connector 100B.

In the coaxial connector 100, when the second connector 100B is pulled in a direction in which the second connector 100B moves away from the first connector 100A, the fitting between the lock grooves 11*c* and the lock projections 21*f* is undone and the connection of the first connector 100A and the second connector 100B is canceled.

The coaxial connector 100 according to the foregoing embodiment has features described below.

In the coaxial connector 100, when the first connector 100A and the second connector 100B are connected, the solder parts 11*b* of the outer conductor 11 of the first connector 100A are received in the cut portions 21*e* of the skirt parts 21*d* of the outer conductor 21 of the second connector 100B. Accordingly, the skirt parts 21*d* can be made long. As a result, in the coaxial connector 100, the induction amount of the skirt parts 21*d* is large, and in connecting the first connector 100A and the second connector 100B, the skirt parts 21*d* can easily abut on the edge portion of the opening of the outer conductor 11 of the second connector 100B. Consequently, alignment in connecting the first connector 100A and the second connector 100B can be facilitated.

In addition, in the coaxial connector 100, when the first connector 100A and the second connector 100B are connected, the solder parts 11*b* of the outer conductor 11 of the first connector 100A are received in the cut portions 21*e* of the skirt parts 21*d* of the outer conductor 21 of the second connector 100B and therefore, even when the skirt parts 21*d* of the outer conductor 21 of the second connector 100B are made long, the height dimension of the coaxial connector 100 caused when the first connector 100A and the second connector 100B are connected can be made small.

Further, in the coaxial connector 100, as illustrated in FIG. 7, when viewed from a center axis Z of the second connector 100B, the direction in which the juncture 22*c* of the connection part 22*a* of the socket 22 is formed agrees with the direction in which the juncture 21*g* of the tubular part 21*a* of the outer conductor 21 is formed. Thus, the socket 22 and the like can be prevented from getting damaged in connecting the first connector 100A and the second connector 100B. That is, in connecting the first connector 100A and the second connector 100B, the tubular part 21*a* of the outer conductor 21 of the second connector 100B is pushed by the tubular part 11*a* of the outer conductor 11 of the first connector 100A and widens in directions of arrows X in the juncture 21*g*. Further, when viewed from the center axis Z, a portion of the tubular part 21*a* in a symmetrical position of the juncture 21*g* is fixed. Thus, the diameter of the tubular part 21*a* increases and a center Z' of the tubular part 21*a* moves upward in FIG. 7. Moreover, in connecting the first connector 100A and the second connector 100B, the connection part 22*a* of the socket 22 of the second connector 100B is pushed by the connection part 12*a* of the center pin 12 of the first connector 100A and widens in directions of arrows Y in the juncture 22*c*. Further, a center Z" of the connection part 22*a* also moves upward in FIG. 7. That is, in the coaxial connector 100, in connecting the first connector 100A and the second connector 100B, the center Z' of the tubular part 21*a* of the outer conductor 21 and the center Z" of the connection part 22*a* of the socket 22 cooperate and move in the same direction. Thus, the socket 22 (the connection part 22*a*) can be prevented from getting damaged. In contrast, if the juncture 21*g* of the tubular part 21*a* of the outer conductor 21 and the juncture 22*c* of the connection part 22*a* of the socket 22 are formed in different directions when viewed from the center axis Z, in connecting the first connector 100A and the second connector 100B, the center Z' of the tubular part 21*a* of the outer conductor 21 and the center Z" of the connection part 22*a* of the socket 22 move in directions different from each other. As a result, unneeded stress may be applied to the socket 22 and the socket 22 may be damaged.

The coaxial connector 100 according to an embodiment is described above. However, the present disclosure is not limited to the contents described above and various changes can be added on the basis of the gist of the disclosure.

For example, in the coaxial connector 100, the outer conductor 11 of the first connector 100A includes two (a pair of) solder parts, 11*b*. However, the number, formation positions, and the like of the solder parts 11*b* may be changed as needed. For example, the number of the solder parts 11*b* may be one. For another example, three solder parts 11*b* may be formed so as to be apart from each other by an angle of 90 degrees.

In the coaxial connector 100, the first connector 100A includes the center pin 12 and the second connector 100B includes the socket 22. Instead, the first connector 100A may include the socket 22 and the second connector 100B may include the center pin 12.

What is claimed is:

1. A coaxial connector comprising:

a first connector including a cylindrical outer conductor, and a center pin or a socket; and a second connector including a cylindrical outer conductor, and a socket or a center pin, the coaxial connector being used by connecting the outer conductor of the first connector and the outer conductor of the second connector, and additionally connecting the center pin of the first connector and the socket of the second connector or additionally connecting the socket of the first connector and the center pin of the second connector, the first connector including a solder part configured for mounting and projecting in a plane direction, a skirt part being integrally formed with the outer conductor of the second connector, the skirt part being configured as a guide for alignment in connecting the first connector and the second connector, a cut portion being provided in a portion that is included in the skirt part and faces the solder part, and when the first connector and the second connector are connected, the solder part is received in the cut portion.

2. The coaxial connector according to claim 1, wherein a lock groove is formed in an outer edge portion of the outer conductor of the first connector, a lock projection is formed in an inner edge portion of the outer conductor of the second connector and in a base portion of the skirt part, and when the first connector and the second connector are connected, the lock projection is fitted in the lock groove.

3. The coaxial connector according to claim 2, wherein the lock groove of the first connector is divided into two portions, and the skirt part and the lock projection of the second connector are also each divided into two portions.

4. The coaxial connector according to claim 3, wherein the cut portion is formed in each of the two portions obtained by dividing the skirt part of the second connector.

5. The coaxial connector according to claim 1, wherein
the first connector includes the center pin,
the second connector includes the socket,
a first slit-like juncture is formed in the outer conductor of the second connector in at least one location, the outer conductor of the second connector being cylindrical,
the socket of the second connector is made up of a cylindrical part and includes a second slit-like juncture formed in at least one location, and
when viewed from a center axis of the second connector, a direction in which the juncture of the outer conductor of the second connector is formed and a direction in which the juncture of the socket of the second connector is formed agree.

6. The coaxial connector according to claim 5, wherein
a lock groove is formed in an outer edge portion of the outer conductor of the first connector,
a lock projection is formed in an inner edge portion of the outer conductor of the second connector and in a base portion of the skirt part, and
when the first connector and the second connector are connected, the lock projection is fitted in the lock groove.

7. The coaxial connector according to claim 6, wherein
the lock groove of the first connector is divided into two portions, and the skirt part and the lock projection of the second connector are also each divided into two portions.

8. The coaxial connector according to claim 7, wherein
the cut portion is formed in each of the two portions obtained by dividing the skirt part of the second connector.

* * * * *